US009691279B2

(12) United States Patent
Maeda

(10) Patent No.: US 9,691,279 B2
(45) Date of Patent: Jun. 27, 2017

(54) DRIVE ASSIST APPARATUS

(71) Applicant: Mitsubishi Electric Corporation, Tokyo (JP)

(72) Inventor: Takashi Maeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 6 days.

(21) Appl. No.: 14/663,827

(22) Filed: Mar. 20, 2015

(65) Prior Publication Data

US 2016/0086486 A1 Mar. 24, 2016

(30) Foreign Application Priority Data

Sep. 24, 2014 (JP) ..... 2014-193412

(51) Int. Cl.

| | |
|---|---|
| ***G06G 7/76*** | (2006.01) |
| ***G08G 1/00*** | (2006.01) |
| ***G08G 1/0962*** | (2006.01) |
| ***G08G 1/0967*** | (2006.01) |

(52) U.S. Cl.

CPC ..... *G08G 1/0962* (2013.01); *G08G 1/096716* (2013.01); *G08G 1/096758* (2013.01); *G08G 1/096783* (2013.01)

(58) Field of Classification Search

CPC ..... G08G 1/0962; G08G 1/096716; G08G 1/096758; G08G 1/096783; G05D 2201/0212; G05D 2201/0213

USPC ..... 701/118, 119, 423, 414

See application file for complete search history.

(56) References Cited

U.S. PATENT DOCUMENTS

| | | | | |
|---|---|---|---|---|
| 9,207,091 | B2 * | 12/2015 | Ota | G08G 1/096716 |
| 2007/0282513 | A1 * | 12/2007 | Michi | B60K 31/0008 701/96 |
| 2007/0299600 | A1 * | 12/2007 | Liberto | G01C 21/3415 701/414 |

(Continued)

FOREIGN PATENT DOCUMENTS

| | | | |
|---|---|---|---|
| JP | 2001155290 | A | 6/2001 |
| JP | 2012-133624 | A | 7/2012 |
| JP | 2014032544 | A | 2/2014 |

OTHER PUBLICATIONS

Communication dated Nov. 17, 2015, from the Japanese Patent Office in counterpart application No. 2014-193412.

*Primary Examiner* — Khoi Tran
*Assistant Examiner* — Jorge Peche
(74) *Attorney, Agent, or Firm* — Sughrue Mion, PLLC; Richard C. Turner

(57) ABSTRACT

Provided is a drive assist apparatus: based on signal indication information on a traffic signal installed at at least one intersection located ahead of a self-vehicle in a travelling direction of the self-vehicle, distance information from the self-vehicle to the at least one intersection, and a running speed of the self-vehicle, a recommended speed at which the self-vehicle can pass through the at least one intersection during a period in which the traffic signal installed at the at least one intersection is green is calculated and is notified to the driver. In addition, when a difference obtained by subtracting an actual running distance from a predicted running distance in a case where the self-vehicle runs at the recommended speed exceeds a first threshold value, it is determined that the road has a traffic jam and the notification of the recommended speed is terminated.

18 Claims, 5 Drawing Sheets

(56) References Cited

U.S. PATENT DOCUMENTS

| | | | | |
|---|---|---|---|---|
| 2008/0012726 | A1* | 1/2008 | Publicover | G08G 1/095 340/932 |
| 2010/0061591 | A1* | 3/2010 | Okada | G01C 7/04 382/103 |
| 2011/0246040 | A1* | 10/2011 | Nakayama | B60T 8/17557 701/70 |
| 2011/0260886 | A1* | 10/2011 | Nagura | G08G 1/081 340/905 |
| 2012/0307065 | A1* | 12/2012 | Mimeault | G08G 1/04 348/149 |
| 2013/0080019 | A1* | 3/2013 | Isaji | B60W 30/16 701/96 |
| 2013/0245945 | A1* | 9/2013 | Morita | G08G 1/096716 701/533 |
| 2014/0046581 | A1* | 2/2014 | Ota | G08G 1/096716 701/408 |
| 2015/0134234 | A1* | 5/2015 | Kim | G01S 13/931 701/408 |
| 2015/0258994 | A1* | 9/2015 | Kidambi | B60W 30/16 701/87 |

* cited by examiner

DRIVE ASSIST APPARATUS

BACKGROUND OF THE INVENTION

1. Field of the Invention

The present invention relates to a drive assist apparatus for calculating a recommended speed at which a self-vehicle can pass through an intersection located ahead of the self-vehicle in a travelling direction of the self-vehicle while a traffic signal installed at the intersection is green and notifying a driver of the calculated recommended speed.

2. Description of the Related Art

As a related-art drive assist apparatus, there is one for informing a driver of a recommended speed suitable for a road on which a self-vehicle is running (see, for example, Japanese Patent Application Laid-open No. 2012-133624). According to Japanese Patent Application Laid-open No. 2012-133624, when it is determined that there is a speed at which a self-vehicle can pass through at least one intersection located ahead of the self-vehicle in a travelling direction of the self-vehicle while a traffic signal installed at the at least one intersection is green based on signal indication information on the traffic signal installed at the at least one intersection, a distance from the self-vehicle to the at least one intersection, and a vehicle state of the self-vehicle, the driver is notified of the speed as a recommended speed.

However, the related art has the following problem.

The drive assist apparatus disclosed in Japanese Patent Application Laid-open No. 2012-133624 does not take traffic situations on the road on which the self-vehicle is running into consideration when calculating the recommended speed at which the self-vehicle can pass through the intersection located ahead of the self-vehicle in the travelling direction of the self-vehicle while the traffic signal installed at the intersection is green. Therefore, when the road has a traffic jam, for example, there is a problem in that the speed, which is not suitable because the traffic jam is not taken into consideration, is undesirably notified.

SUMMARY OF THE INVENTION

The present invention has been made to solve the problem described above, and has an object to provide a drive assist apparatus capable of more appropriately notifying a driver of a recommended speed in consideration of a traffic jam on a road without requiring any additional apparatus.

A drive assist apparatus according to one embodiment of the present invention includes: an intersection-information acquiring section for acquiring intersection information containing signal indication information on a traffic signal installed at at least one intersection located ahead of a vehicle in a travelling direction of the vehicle and distance information from the vehicle to the at least one intersection through an infrastructure communication apparatus outside of the vehicle; a vehicle-state detecting section for detecting a running speed of the vehicle; an intersection passage determining section for calculating, as a recommended speed, a speed of the vehicle at which the vehicle is capable of passing through the at least one intersection during a period in which the traffic signal installed at the at least one intersection is green; an information providing section for notifying a driver of the vehicle of the recommended speed; a running-distance measuring section for measuring an actual running distance of the vehicle from a time at which the intersection information is acquired, based on the running speed; a running-distance predicting section for calculating a predicted running distance of the vehicle from the time at which the intersection information is acquired in a case where the vehicle runs at the recommended speed, based on the intersection information and the recommended speed; and a traffic-jam detecting section for determining that a road on which the vehicle is running has a traffic jam when a first running distance difference obtained by subtracting the actual running distance from the predicted running distance exceeds a first threshold value which defines an upper limit of the first running distance difference. In the drive assist apparatus, the intersection passage determining section calculates, as the recommended speed, the speed of the vehicle at which the vehicle is capable of passing through at least a first intersection to pass through of the at least one intersection during the period in which the traffic signal installed at the first intersection is green, based on the intersection information, the running speed, and the actual running distance, and the information providing section terminates the notification of the recommended speed when the traffic-jam detecting section detects occurrence of the traffic jam.

According to one embodiment of the present invention, based on the signal indication information on the traffic signal installed at the at least one intersection located ahead of the self-vehicle in the travelling direction of the self-vehicle, the distance information from the self-vehicle to the at least one intersection, and the running speed of the self-vehicle, the recommended speed at which the self-vehicle can pass through the at least one intersection while the traffic signal installed at the at least one intersection is green is calculated and is notified to the driver. In addition, when the difference obtained by subtracting the actual running distance from the predicted running distance in the case where the self-vehicle runs at the recommended speed exceeds the first threshold value, it is determined that the road has the traffic jam and the notification of the recommended speed is terminated. As a result, the drive assist apparatus capable of more appropriately notifying the driver of the recommended speed in consideration of the traffic jam on the road without requiring any additional apparatus can be obtained.

DETAILED DESCRIPTION OF THE PREFERRED EMBODIMENTS

Figure 1:
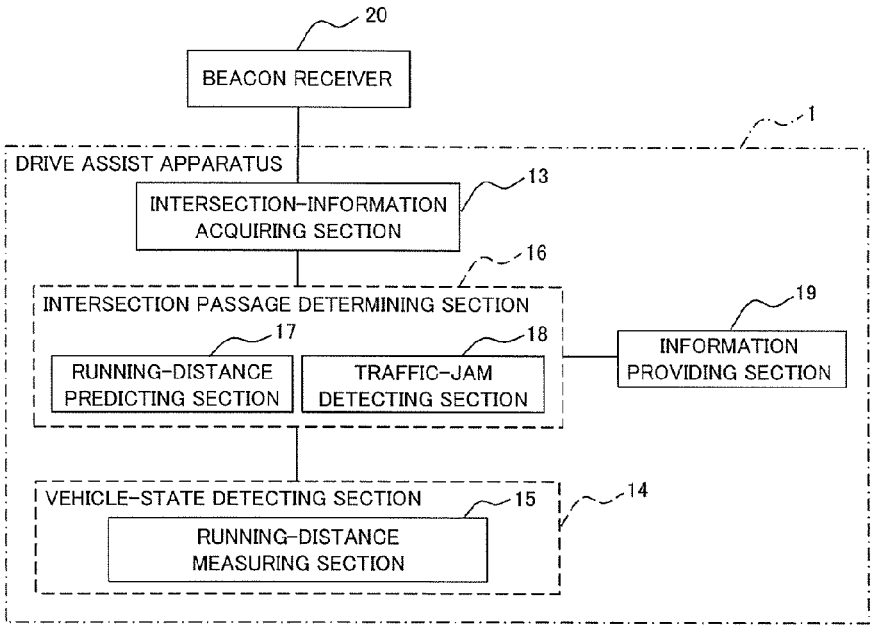
FIG. 1 is a block diagram illustrating a configuration of a drive assist apparatus according to a first embodiment of the present invention.

Now, drive assist apparatus according to preferred embodiments of the present invention are described referring to the accompanying drawings. In the drawings, the same or corresponding parts are denoted by the same reference symbols for description.

First Embodiment

FIG. 1 is a block diagram illustrating a configuration of a drive assist apparatus 1 according to a first embodiment of the present invention. The drive assist apparatus 1 according to the first embodiment illustrated in FIG. 1 includes an intersection-information acquiring section 13, a vehicle-state detecting section 14, an intersection passage determining section 16, and an information providing section 19. Moreover, the vehicle-state detecting section 14 includes a running-distance measuring section 15. The intersection passage determining section 16 includes a running-distance predicting section 17 and a traffic-jam detecting section 18. Moreover, as illustrated in FIG. 1, a beacon receiver 20 is connected to the drive assist apparatus 1.

Figure 2:
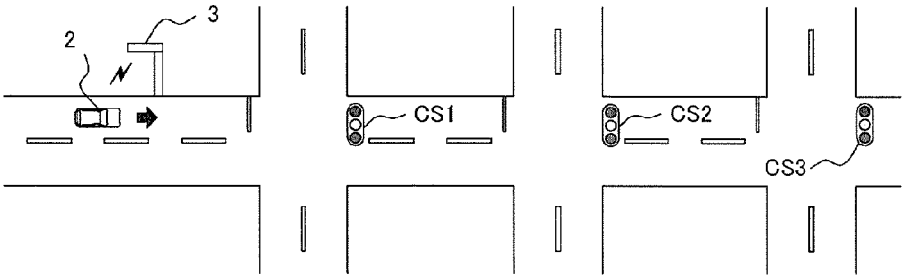
FIG. 2 is an exemplary diagram illustrating roads and intersections, for which the drive assist apparatus according to the first embodiment of the present invention is employed.

FIG. 2 is an exemplary diagram illustrating roads and intersections, for which the drive assist apparatus 1 according to the first embodiment of the present invention is employed. The drive assist apparatus 1 and the beacon receiver 20 illustrated in FIG. 1 are mounted in a vehicle 2 illustrated in FIG. 2. The drive assist apparatus 1 and the beacon receiver 20 are realized, for example, as one function of a car navigation apparatus or a road-vehicle communication apparatus which is mounted in the vehicle 2. The vehicle 2 may not only be an automobile but also any one of an autobicycle and a bicycle.

A roadside infrared beacon 3 is provided on the side of a road just before the intersection in a traveling direction of the vehicle 2. The roadside infrared beacon 3 includes an infrared beacon header and uses an infrared ray emitted from the infrared beacon header to perform communication to/from the vehicle 2. When the vehicle 2 enters a communication region of the infrared beacon header, the beacon receiver 20 of the vehicle 2 receives intersection information transmitted from the roadside infrared beacon 3 to transfer the receiver intersection information to the drive assist apparatus 1.

Here, the intersection information includes: signal indication information on a traffic signal (for example, traffic signals CS1 to CS3 illustrated in FIG. 2) installed at at least one intersection located ahead of a location where the roadside infrared beacon 3 is installed in the traveling direction of the vehicle 2; and a distance to the at least one intersection located ahead of the location where the roadside infrared beacon 3 is installed in the traveling direction of the vehicle 2, specifically, a distance from the position of the vehicle 2 at the time of reception of the intersection information to the intersection.

Further, the signal indication information includes light-color states (blue, yellow, or red) and lighting time periods or lighting remaining time periods of the traffic signals CS1 to CS3 for several cycles including current and future cycles. Therefore, the drive assist apparatus 1 can obtain the light-color states and the lighting time periods of the traffic signals CS1 to CS3 at an arbitrary time from the signal indication information.

FIG. 2 illustrates an example where the intersection information to be transmitted from the roadside infrared beacon 3 includes the signal indication information on the traffic signals CS1 to CS3 installed at three intersections located ahead of the roadside infrared beacon 3 in the traveling direction of the vehicle 2 and the distance information to the three intersections located ahead of the roadside infrared beacon 3 in the traveling direction of the vehicle 2. However, the configuration of the first embodiment is not limited to the configuration described above. The intersection information may include any information as long as intersection information includes the signal indication information on the traffic signal installed at at least one intersection located ahead of the vehicle 2 in the travelling direction of the vehicle 2 and the distance information from the roadside infrared beacon 3 to the intersection.

Next, the constituent elements of the drive assist apparatus 1 and the beacon receiver 20 illustrated in FIG. 1 are specifically described referring to FIGS. 1 and 2.

The beacon receiver 20 is mounted in the vehicle 2. The beacon receiver 20 receives the intersection information from the roadside infrared beacon 3 installed on the side of the road on which the vehicle 2 runs and transfers the received intersection information to the intersection-information acquiring section 13.

The intersection-information acquiring section 13 acquires the signal indication information on the traffic signals CS1 to CS3 installed at the intersections located ahead of the vehicle 2 in the travelling direction and the distance information from the roadside infrared beacon 3 to the intersections, from the intersection information transferred from the beacon receiver 20.

The vehicle-state detecting section 14 detects an actual running speed of the vehicle 2.

The running-distance measuring section 15 measures an actual running distance of the vehicle 2 after the vehicle 2 passes through the roadside infrared beacon 3 based on the information including the running speed of the vehicle 2, which is detected by the vehicle-state detecting section 14, and an elapsed time after the vehicle 2 passes through the roadside infrared beacon 3.

The intersection passage determining section 16 calculates a recommended speed of the vehicle 2, at which the vehicle 2 can pass through the at least one intersection located ahead of the vehicle 2 in the traveling direction of the vehicle 2 while the traffic signal (for example, the traffic signals CS1 to CS3 illustrated in FIG. 2) is green, based on the following three pieces of information:

(1) the intersection information acquired by the intersection-information acquiring section 13, specifically, the signal indication information and the distance information to the intersection;

(2) the running speed of the vehicle 2, which is detected by the vehicle-state detecting section 14; and (3) the running distance from the roadside infrared beacon 3, which is measured by the running-distance measuring section 15.

A specific method of calculating the recommended speed is described later referring to FIG. 4.

The running-distance predicting section 17 calculates a predicted running distance after the vehicle 2 passes through the roadside infrared beacon 3 in the case where the vehicle 2 runs at the recommended speed based on the following two pieces of information and the information on the elapsed time after the vehicle 2 passes through the roadside infrared beacon 3:

(1) the intersection information acquired by the intersection-information acquiring section 13, specifically, the signal indication information and the distance information to the intersection; and (2) the recommended speed calculated by the intersection passage determining section 16.

The traffic-jam detecting section 18 compares the predicted running distance calculated by the running-distance predicting section 17 with the actual running distance measured by the running-distance measuring section 15 to determine whether or not the road on which the vehicle 2 is running has a traffic jam.

The information providing section 19 notifies the recommended speed calculated by the intersection passage determining section 16 to the driver of the vehicle 2. As a method of notifying the recommended speed, for example, a display, a meter, an LED, a beep, or an audio output can be used. Further, another device provided in the vehicle 2, for example, a portable terminal brought therein by the driver can also be used.

Figure 3:
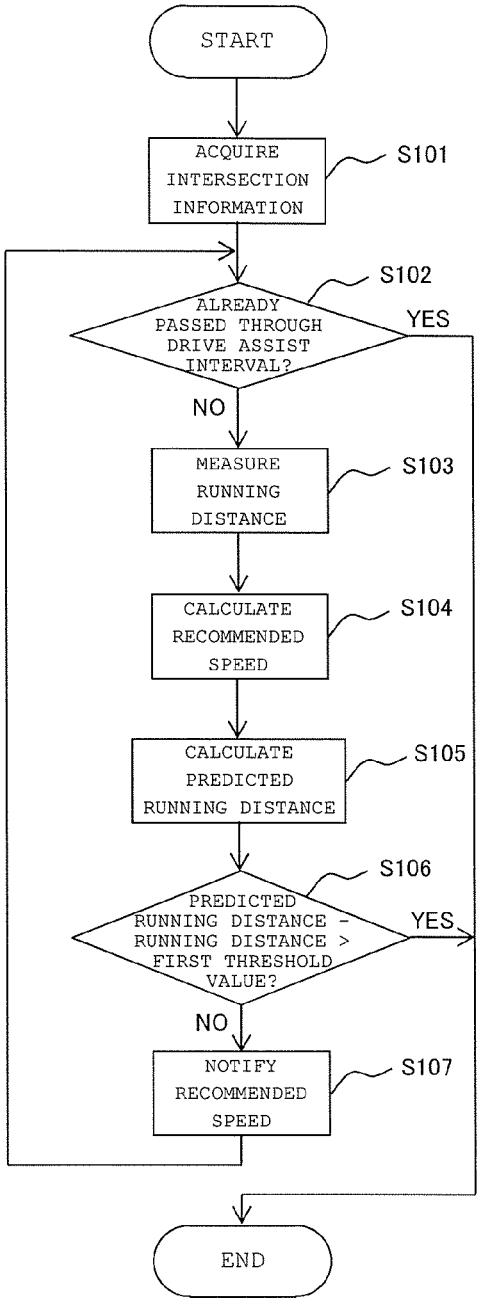
FIG. 3 is a flowchart illustrating an operation of the drive assist apparatus according to the first embodiment of the present invention.

FIG. 3 is a flowchart illustrating an operation of the drive assist apparatus 1 according to the first embodiment of the present invention. FIG. 3 specifically illustrates processing of calculating the recommended speed at which the vehicle 2 can pass through the intersections located ahead of the vehicle 2 while the traffic signals CS1 to CS3 are green and processing of detecting a traffic jam by comparing the predicted running distance and the actual running distance of the vehicle 2 with each other. Now, the operation of the drive assist apparatus 1 is described referring to FIG. 3.

In Step S101, the beacon receiver 20 first receives the intersection information from the roadside infrared beacon 3 installed on the side of the road and transfers the received intersection information to the intersection-information acquiring section 13. Next, the intersection-information acquiring section 13 outputs the intersection information to the intersection passage determining section 16.

In Step S102, the intersection passage determining section 16 determines whether or not the vehicle 2 has already passed through a drive assist interval based on the intersection information acquired by the intersection-information acquiring section 13 and the actual running distance measured by the running-distance measuring section 15. More specifically, it is determined whether or not the vehicle 2 has passed through the last intersection to pass through among the intersections contained in the intersection information. In the case where the vehicle 2 is currently running through the drive assist interval, the processing proceeds to Step S103. On the other hand, in the case where the vehicle 2 has already passed through the drive assist interval, the processing is terminated.

In Step S103, the running-distance measuring section 15 measures the actual running distance after the vehicle 2 passes through the roadside infrared beacon 3 based on the information including the running speed of the vehicle 2 and the elapsed time after the vehicle 2 passes through the roadside infrared beacon 3.

In Step S104, the intersection passage determining section 16 calculates the recommended speed of the vehicle 2 at which the vehicle 2 can pass through the at least one intersection located ahead of the vehicle 2 while the traffic signals CS1 to CS3 are green based on the intersection information, the running speed of the vehicle 2, and the running distance after the vehicle 2 passes through the roadside infrared beacon 3.

In Step S105, the running-distance predicting section 17 calculates the predicted running distance after the vehicle 2 passes through the roadside infrared beacon 3 based on the intersection information, the recommended speed calculated by the intersection passage determining section 16, and the elapsed time after the vehicle 2 passes through the roadside infrared beacon 3.

In Step S106, the traffic-jam detecting section 18 obtains a first running distance difference obtained by subtracting the running distance measured by the running-distance measuring section from the predicted running distance calculated by the running-distance predicting section 17. When the calculated first running distance difference exceeds a first threshold value which defines an upper limit of the first running distance difference, it is determined that the road on which the vehicle 2 is running has a traffic jam and the calculation of the recommended speed is terminated. Further, the information providing section 19 terminates the notification of the recommended speed to the driver of the vehicle 2. For the termination of the notification, the driver of the vehicle 2 may be notified of the termination of the notification of the recommended speed by using the information providing section 19.

On the other hand, when the difference between the predicted running distance and the running distance is equal to or smaller than the first threshold value, the processing proceeds to Step S107. The first threshold value to be used for the determination of occurrence of the traffic jam may be a fixed value (for example, a distance when the vehicle 2 runs at 30 km per hour) or may be a value calculated based on the intersection information (for example, a distance when the vehicle 2 runs at ½ of the recommended speed).

In Step S107, the intersection passage determining section 16 transmits the recommended speed calculated in Step S104 to the information providing section 19. The information providing section 19 notifies the received recommended speed to the driver of the vehicle 2. Thereafter, the processing returns to Step S102 to repeat the processing described above.

Figure 4:
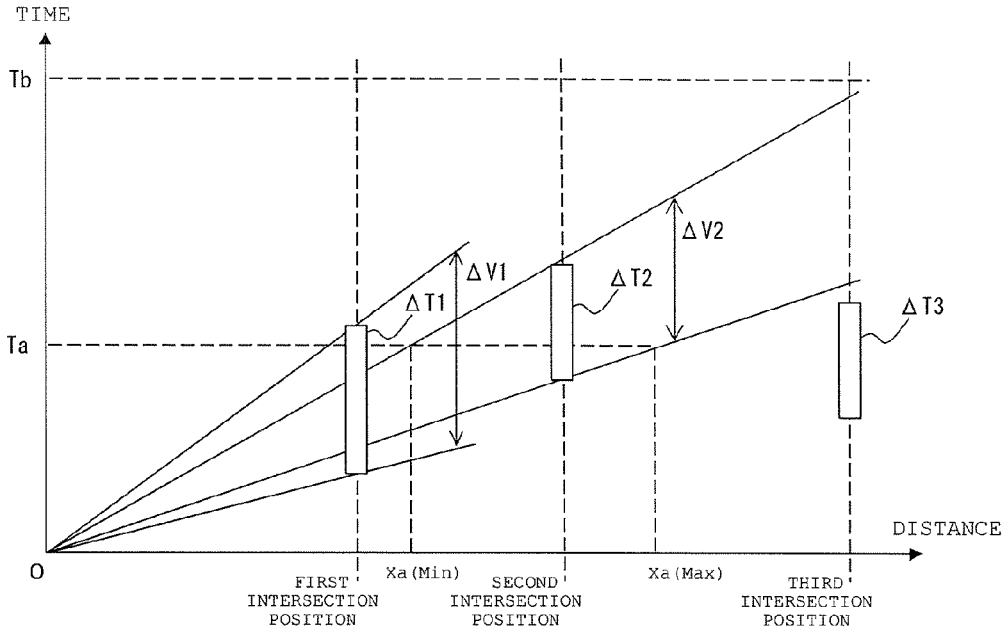
FIG. 4 is an exemplary graph showing a schema of a method of calculating a recommended speed and a predicted running distance to each of the intersections located ahead of a vehicle in the drive assist apparatus according to the first embodiment of the present invention.

FIG. 4 is an exemplary graph showing a scheme of a method of calculating the recommended speed and the predicted running distance to the intersection ahead of the vehicle 2 in the drive assist apparatus 1 according to the first embodiment of the present invention. A horizontal axis of FIG. 4 represents a distance from the vehicle 2 to the intersection, whereas a vertical axis of FIG. 4 represents the elapsed time from a current time.

FIG. 4 shows an example where a first intersection, a second intersection, and a third intersection are present ahead of the vehicle 2 in the stated order in the travelling direction of the vehicle 2, and the traffic signal CS1, the traffic signal CS2, and the traffic signal CS3 are respectively installed at the first to third intersections.

First, the intersection passage determining section 16 calculates a start time and an end time of a time period in which each of the traffic signals CS1 to CS3 is green based on the signal indication information on the traffic signals CS1 to CS3. Then, as shown in FIG. 4, time ranges $\Delta T1$, $\Delta T2$, and $\Delta T3$ in which the vehicle 2 can pass through the first to third intersections while the traffic signals CS1 to CS3 are green are obtained.

Next, the intersection passage determining section 16 draws two straight lines, specifically, one straight line which connects a point of origin of FIG. 4 to lower ends of the time ranges $\Delta T1$ to $\Delta T3$ and the other straight line which connects the point of origin of FIG. 4 to upper ends of the time ranges $\Delta T1$ to $\Delta T3$. A gradient of each of the straight lines corresponds to the speed (an inverse of the speed). Therefore, an upper limit and a lower limit of the speed at which the vehicle 2 can pass through the intersections while the traffic signals CS1 to CS3 are green can be calculated from the gradients of the two straight lines. For example, FIG. 4 shows a speed range $\Delta V1$ of the speed at which the vehicle 2 can pass through the first intersection while the traffic signal CS1 is green and a speed range $\Delta V2$ of the speed at which the vehicle 2 can pass through the second intersection while the traffic signal CS2 is green.

As described above, the speed ranges ΔV1 to ΔV3 of the speed at which the vehicle 2 can pass through the first to third intersections while the traffic signals CS1 to CS3 are green are calculated. By obtaining an overlapping region of the speed ranges ΔV1 to ΔV3, the recommended speed at which the vehicle 2 can pass through all the intersections while the traffic signals CS1 to CS3 are green can be obtained.

If there is no overlapping region for all the speed ranges ΔV1 to ΔV3, the last intersection (third intersection in this case) to pass through is excluded. In this manner, the recommended speed at which the vehicle 2 can pass through the first and second intersections can be obtained. By repeating the above-mentioned procedure, the speed at which the vehicle 2 can pass through at least the first intersection to pass through of the at least one intersection while the traffic signal is green can be calculated as the recommended speed.

For example, although the recommended speed at which the vehicle 2 can pass through the first to third intersections while the traffic signals CS1 to CS3 are green cannot be calculated in FIG. 4, the speed range ΔV2 can be calculated as the recommended speed at which the vehicle 2 can pass through the first and second intersections while the traffic signals CS1 and CS2 are green. Therefore, the driver only needs to be notified of the speed range ΔV2 as the recommended speed. The recommended speed to be notified at this time may be a speed range or may be a representative value within the speed range (for example, an upper limit value, a lower limit value, or a median value).

Next, the running-distance predicting section 17 calculates the predicted running distance in the case where the vehicle 2 runs at the recommended speed. For example, in FIG. 4, the predicted running distance of the vehicle 2 at a time Ta is represented by a length between Xa (minimum value) and Xa (maximum value) which are horizontal-axis coordinate values of intersections between the two straight lines which define the speed range ΔV2 indicating the recommended speed and the time Ta.

Moreover, in FIG. 4, in the case where the vehicle 2 runs at the speed within the speed range ΔV2, the traffic signal CS3 installed at the third intersection turns red before the vehicle 2 passes through the third intersection. Therefore, a waiting time for green signal is generated. Therefore, in this case, in consideration of the waiting time, the running-distance predicting section 17 calculates the predicted running distance of the vehicle 2 at a time Tb by regarding the position of the vehicle 2 as remaining at the third intersection.

As described above, when the difference between the predicted running distance in the case where the vehicle 2 runs at the recommended speed and the actual running distance exceeds the first threshold value, it is determined that the traffic jam occurs to terminate the notification of the recommended speed. As a result, an unsuitable speed without consideration of the traffic jam can be prevented from being disadvantageously notified as the recommend speed. Moreover, an additional apparatus is not required in order to detect the traffic jam. Therefore, the configuration of the drive assist apparatus 1 can be simplified. Moreover, the configuration of the existing drive assist apparatus 1 can be directly used.

As described above, in the first embodiment, the recommended speed at which the self-vehicle can pass through the at least one intersection located ahead of the self-vehicle in the travelling direction of the self-vehicle while the traffic signal installed at the at least one intersection is green is calculated to be notified to the driver based on the signal indication information on the traffic signal installed at the at least one intersection, the distance information from the self-vehicle to the intersection, and the running speed of the self-vehicle. In addition, when the difference obtained by subtracting the actual running distance from the predicted running distance in the case where the self-vehicle runs at the recommended speed exceeds the first threshold value, it is determined that the traffic jam occurs on the road and the notification of the recommended speed is terminated. As a result, the drive assist apparatus capable of more appropriately notifying the driver of the recommended speed in consideration of the traffic jam on the road without requiring an additional apparatus can be obtained.

Second Embodiment

In the first embodiment described above, the method involving terminating the notification of the recommended speed when it is determined that the traffic jam occurs is described. On the other hand, in a second embodiment of the present invention, a method involving restarting the notification of the recommended speed to the driver even after the termination of the notification of the recommended speed in the case where it is determined that the traffic jam has been solved is described.

Figure 5:
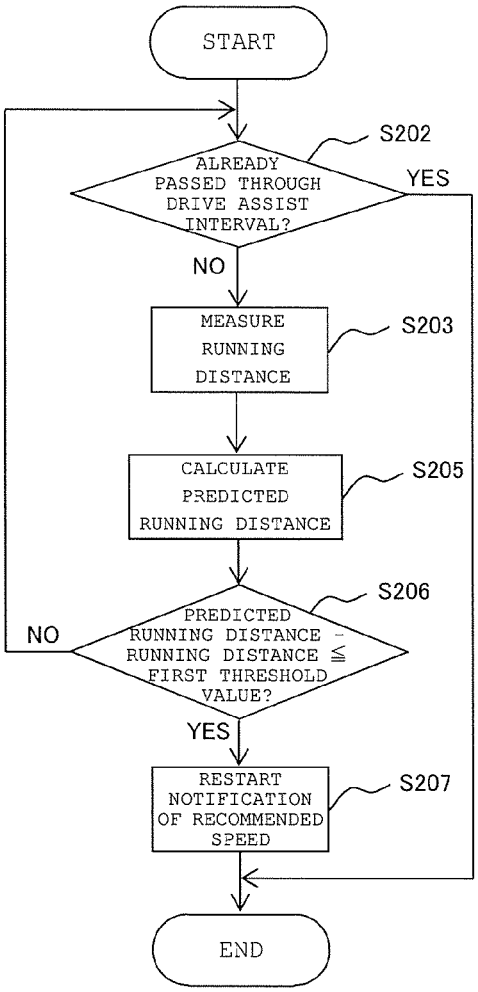
FIG. 5 is a flowchart illustrating an operation of a drive assist apparatus according to a second embodiment of the present invention.

FIG. 5 is a flowchart illustrating an operation of the drive assist apparatus 1 according to the second embodiment of the present invention. A configuration of the drive assist apparatus 1 according to the second embodiment is the same as that illustrated in FIG. 1 according to the first embodiment described above.

The drive assist apparatus 1 according to the second embodiment first operates in accordance with the flowchart of FIG. 3 according to the first embodiment described above. Then, in Step S106 of FIG. 3, when it is determined that the road has a traffic jam based on the difference between the predicted running speed and the running distance, which exceeds the first threshold value, the notification of the recommended speed to the driver is terminated. Thereafter, the drive assist apparatus 1 operates in accordance with the flowchart of FIG. 5.

Now, the operation of the drive assist apparatus 1 according to the second embodiment is described referring to FIG. 5. Processing in Steps S202 to S205 of FIG. 5 is the same as that in Steps S102 to S105 (except for Step S104) illustrated in FIG. 3 according to the first embodiment described above, and hence the description thereof is herein omitted.

In Step S206, the traffic-jam detecting section 18 obtains the first running distance difference obtained by subtracting the running distance measured by the running-distance measuring section from the predicted running distance calculated by the running-distance predicting section 17. When the first running distance difference is equal to or smaller than the first threshold value, it is determined that the traffic jam on the road on which the vehicle 2 is running has been solved. Then, the processing proceeds to Step S207.

In Step S207, in order to restart the calculation of the recommended speed, the traffic-jam detecting section 18 restarts the processing after Step S102 of FIG. 3 referred to in the first embodiment described above. In this manner, the information providing section 19 restarts notifying the driver of the recommended speed. In this case, the information providing section 19 may notify the driver of the restart of the notification of the recommended speed.

As described above, in the second embodiment, when the difference obtained by subtracting the actual running speed of the self-vehicle from the predicted running distance in the case where the self-vehicle runs at the recommended speed becomes equal to or smaller than the first threshold value, it is determined that the traffic jam has been solved and the notification of the recommended speed is restarted. As a result, the drive assist apparatus capable of appropriately notifying the driver of the recommended speed in additional consideration of the traffic jam on the road can be obtained.

Third Embodiment

In a third embodiment of the present invention, a method involving terminating the notification of the recommended speed to the driver not only when it is determined that the traffic jam occurs but also when it is determined that a data content of the intersection information has an abnormality is described.

Figure 6:
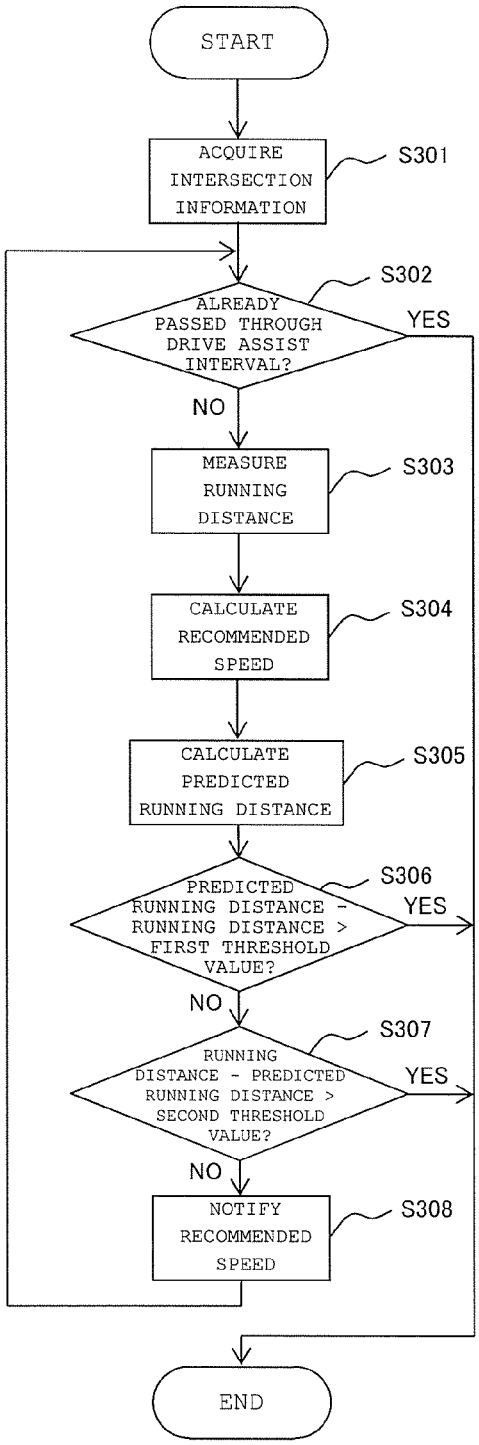
FIG. 6 is a flowchart illustrating an operation of a drive assist apparatus according to a third embodiment of the present invention.

FIG. 6 is a flowchart illustrating an operation of the drive assist apparatus 1 according to the third embodiment of the present invention. A configuration of the drive assist apparatus 1 according to the third embodiment is the same as that illustrated in FIG. 1 according to the first embodiment described above.

In FIG. 6, Step S307 is added to the flowchart of FIG. 3 according to the first embodiment described above. Processing in Steps S301 to S306 of FIG. 6 is the same as that in Steps S101 to S106 illustrated in FIG. 3 according to the first embodiment described above, and hence the description thereof is herein omitted.

In Step S307, the traffic-jam detecting section 18 calculates a second running distance difference obtained by subtracting the predicted running distance calculated by the running-distance predicting section 17 from the running distance measured by the running-distance measuring section 15. When the calculated difference exceeds a second threshold value regarding a data abnormality of the intersection information, it is determined that a data content of the intersection information has an abnormality and the calculation of the recommended speed is terminated. Further, the information providing section 19 terminates the notification of the recommended speed to the driver. At this time, the information providing section 19 may be used to notify the termination of the notification of the recommended speed to the driver.

On the other hand, when the difference between the running distance and the predicted running distance is equal to or smaller than the second threshold value, the processing proceeds to Step S308. The processing in Step S308 is the same as that in Step S107 of FIG. 3 referred to in the first embodiment described above. Therefore, the description thereof is herein omitted.

As a factor of the occurrence of an abnormality in the intersection information, for example, mismatching of the signal indication information with the actual traffic signal change or inappropriate setting of the distance information to the intersection are conceivable. In such a case, the running distance measured by the running-distance measuring section 15 becomes larger than the predicted running distance calculated by the running-distance predicting section 17. Thus, the abnormality in the intersection information can be detected by the traffic-jam detecting section 18.

Similarly to the first threshold value described above, the second threshold value used for the determination of an abnormality in the intersection information may also be a fixed value or a value calculated based on the intersection information.

As described above, in the third embodiment, when the difference obtained by subtracting the predicted running distance in the case where the self-vehicle runs at the recommended speed from the actual running distance of the self-vehicle exceeds the second threshold value, it is determined that the data content of the intersection information has an abnormality and the notification of the recommended speed to the driver is terminated. As a result, the drive assist apparatus capable of appropriately notifying the driver of the recommended speed in consideration of the abnormality in the intersection information can be obtained.

In the first to third embodiments, the configuration in which the intersection information transmitted from the roadside infrared beacon 3 installed on the side of the road is acquired through the beacon receiver 20 mounted in the vehicle 2 is described above. However, the intersection information may be obtained by using communication through an infrastructure communication apparatus such as a wireless LAN, WAVE vehicle-to-vehicle communication, Bluetooth™, 700 MHz-band vehicle-to-vehicle communication, 5 GHz-band vehicle-to-vehicle communication, 5.8 GHz dedicated short range communications (DSRC; trademark) or communication to/from a cellular phone through a cellular phone base station.

What is claimed is:

1. A method of assisting a driver, the method comprising:

acquiring intersection information containing signal indication information on a traffic signal installed at at least one intersection located ahead of a vehicle in a travelling direction of the vehicle and distance information from the vehicle to the at least one intersection through an infrastructure communication apparatus outside of the vehicle;

detecting a running speed of the vehicle;

calculating, as a recommended speed, a speed of the vehicle at which the vehicle can pass through the at least one intersection during a period in which the traffic signal installed at the at least one intersection is green;

notifying a driver of the vehicle of the recommended speed;

measuring an actual running distance of the vehicle from a time at which the intersection information is acquired, based on the running speed;

calculating a predicted running distance of the vehicle from the time at which the intersection information is acquired in a case where the vehicle runs at the recommended speed, based on the intersection information and the recommended speed; and determining that a road on which the vehicle is running has a traffic jam when a first running distance difference obtained by subtracting the actual running distance from the predicted running distance exceeds a first threshold value which defines an upper limit of the first running distance difference, wherein:

the recommended speed is calculated as the speed of the vehicle at which the vehicle can pass through at least a first intersection to pass through of the at least one intersection during the period in which the traffic signal installed at the first intersection is green, based on the intersection information, the running speed, and the actual running distance; and the notification of the recommended speed is terminated when the traffic-jam detecting section detects occurrence of the traffic jam.

2. The method according to claim 1, further comprising notifying the driver of the termination of the notification of the recommended speed when the occurrence of the traffic jam is detected.

3. The method according to claim 1, further comprising:

continuing to compare the predicted running distance and the running distance with each other even after detecting the occurrence of the traffic jam and determining that the traffic jam has been solved when the first running distance difference becomes equal to or smaller than the first threshold value; and restarting the notification of the recommended speed when it is determined that the traffic jam has been solved.

4. The method according to claim 2, further comprising:

continuing to compare the predicted running distance and the running distance with each other even after detecting the occurrence of the traffic jam and determining that the traffic jam has been solved when the first running distance difference becomes equal to or smaller than the first threshold value; and restarting the notification of the recommended speed when it is determined that the traffic jam has been solved.

5. The method according to claim 3, further comprising notifying the driver of the restart of the notification of the recommended speed when it is determined that the traffic jam has been solved.

6. The method according to claim 4, further comprising notifying the driver of the restart of the notification of the recommended speed when it is determined that the traffic jam has been solved.

7. The method according to claim 1, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

8. The method according to claim 2, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

9. The method according to claim 3, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

10. The method according to claim 4, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

11. The method according to claim 5, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

12. The method according to claim 6, further comprising:

determining that a data content of the intersection information has an abnormality when a second running distance difference obtained by subtracting the predicted running distance from the running distance exceeds a second threshold value regarding a data abnormality of the intersection information; and terminating the notification of the recommended speed when it is determined that the data content of the intersection information has the abnormality.

13. The method according to claim 7, further comprising notifying the driver of the termination of the recommended speed when it is determined that the data content of the intersection information has the abnormality.

14. The method according to claim 8, further comprising notifying the driver of the termination of the recommended speed when it is determined that the data content of the intersection information has the abnormality.

15. The method according to claim 9, further comprising notifying the driver of the termination of the recommended speed when it is determined that the data content of the intersection information has the abnormality.

16. The method according to claim 10, further comprising notifying the driver of the termination of the recommended speed when it is determined that the data content of the intersection information has the abnormality.

17. The method according to claim 11, further comprising notifying the driver of the termination of the recommended speed when it is determined that the data content of the intersection information has the abnormality.

18. The method according to claim 12, further comprising notifying the driver of the termination of the recommended speed when it is determined that the data content of the intersection information has the abnormality.

* * * * *